US005802894A

United States Patent [19]

Jahrsetz et al.

[11] Patent Number: 5,802,894

[45] Date of Patent: Sep. 8, 1998

[54] CENTRAL LOCKING SYSTEM FOR AN AUTOMOTIVE VEHICLE WITH STRUCTURALLY IDENTICAL DOOR LOCKS

[75] Inventors: Achim Jahrsetz, Velbert; Frank Kleefeldt, Heiligenhaus; Wilfried Ostermann, Essen; Fred Welskopf, Herne, all of Germany

[73] Assignee: Kiekert AG, Heiligenhaus, Germany

[21] Appl. No.: 653,366

[22] Filed: Jun. 10, 1996

[30] Foreign Application Priority Data

Aug. 18, 1995 [DE] Germany ..... 195 30 726.7

[51] Int. Cl.[6] ..... E05B 63/00

[52] U.S. Cl. ..... 70/264; 292/201; 292/144; 292/DIG. 23; 70/278

[58] Field of Search ..... 70/264, 275, 278; 292/201, 216, 144, DIG. 3, DIG. 23, DIG. 42, DIG. 43

[56] References Cited

U.S. PATENT DOCUMENTS

| | | | |
|---|---|---|---|
| 3,751,950 | 8/1973 | Lager . | |
| 4,135,377 | 1/1979 | Kieefeldt | 70/264 |
| 4,986,098 | 1/1991 | Fisher | 292/201 |
| 5,020,838 | 6/1991 | Fukumoto | 292/201 |
| 5,054,300 | 10/1991 | Nakahara | 70/264 |
| 5,066,054 | 11/1991 | Ingenhoven | 292/201 |
| 5,229,648 | 7/1993 | Sues . | |
| 5,494,322 | 2/1996 | Manke | 292/201 |

FOREIGN PATENT DOCUMENTS

| | | | |
|---|---|---|---|
| 42 28 233 | 3/1994 | Germany . | |
| 20684 | 1/1992 | Japan | 70/264 |
| 2118615 | 11/1983 | United Kingdom | 70/264 |

*Primary Examiner*—Flemming Saether
*Attorney, Agent, or Firm*—Herbert Dubno

[57] ABSTRACT

A central control system for the door locks of a motor vehicle has a central unit connected to the door locks via a control line and the door locks each have a first electrically-operable actuator and a second electrically-operable actuator together enabling the "operate", "locked and unlocked", "antitheft mode on and off" and "child-safety mode on and off" operations. The door locks can be mechanically identical and can have a keeper pawl controlled both by the first actuator and an interior lever which is effective only when the second operator has displaced a lever from its ineffective position into an effective position.

8 Claims, 3 Drawing Sheets

CENTRAL LOCKING SYSTEM FOR AN AUTOMOTIVE VEHICLE WITH STRUCTURALLY IDENTICAL DOOR LOCKS

FIELD OF THE INVENTION

Our present invention relates to a central locking system for motor vehicle door locks and, more particularly, to a central locking system for a multiplicity of vehicle door locks in which at least a plurality of the door locks operated from an electrical control unit can be practically structurally identical, i.e. can have structurally equivalent assemblies of levers, bolts and the like.

BACKGROUND OF THE INVENTION

Electrically-operated door lock systems for motor vehicles may comprise, in addition to a plurality of electrically-operable door locks, a central control unit and at least one conductor delivering signals from that central unit to the the door locks for operating same.

Motor vehicle door locks can include a rotary bolt and a keeper, in the form of a locking pawl, which can be pivotally displaceable into engagement with the rotary bolt so as to retain the bolt against opening in a locked state.

The keeper can be displaceable out of its locking position by means of an electrically-operated effector, i.e. an electrically-controllable operator, or by a lever which can be referred to as an interior actuating lever. Either of these effectors can displace the locking pawl from its locked mode into its unlocked mode and thus prepare the bolt so that it can be rotated into an opening position. The position in which the bolt is free to rotate for opening and closing of the door can be referred to as the "operate" position. When the keeper is in place to block rotation of the bolt, the bolt is locked. When the keeper is out of position and thus cannot block rotation of the bolt, the mechanism is unlocked.

The electrical systems which have been used heretofore have been able to switch the lock between "operate" and "lock and unlock" functions. The "operate" function, when the rotary bolt engages the pin on a doorpost of the vehicle, is equivalent to a latched function of the lock and, of course, when the door is open and the rotary bolt is positioned to receive the doorpost pin, the lock can be said to be unlatched.

The electrical system which is used to control the door locks can, in earlier systems, include switches in the interior of the vehicle which can control the locks individually or selectively or collectively and/or a portable unit which can, from a location remote from the vehicle, be operated to actuate the door locks. In that case, the portable or remote control unit can communicate with the vehicle by a wireless system, using infrared light or high frequency or radio waves. For that purpose, the remote operator can be provided with a transmitter while the central control unit on the vehicle has the respective or corresponding receiver.

The control system can satisfy other functions and control operations as may be desirable or advantageous, for example, the operation or control of internal lighting, a sliding roof or sun-roof panel, a window lifter, a mirror adjustment, a seat setting and/or the operation of a cabriolet roof. The control system thus can be said to provide comfort functions related to the entry of a person into the vehicle or a departure of a person from the vehicle.

A control system for the electrically-operated components of an automotive vehicle can carry out the various control functions by the discrete wiring for the respective components or through the use of a microprocessor with respective peripherals connected in a control system. In the latter case, the control functions can be programmed into the system.

Apart from the door locks, a central control system and especially a central lock control system, may operate other vehicle closures such as the engine hood lock, the trunk lock, a rear door lock, a glove compartment lock and/or a fuel tank cover lock. All of these functions can be integrated into the central control system.

When reference is made here to electrically-controlled operators, we intend to include any effectors which can be energized by an electric current and can result in a mechanical rotation or translation of the actuated part or component. Such elements include electropneumatic drives, electromagnetic drives (e.g. solenoids) and electric motor drives.

For an electrical control unit of the prior art type mentioned above, reference may be had to German patent document DE 42 28 233. In this system, each door lock has a single electrically-operated effector which acts upon the keeper and also upon the coupling lever. To that extent the electrically-controlled operator serves a dual function. The coupling lever is, in turn, not only mechanically connected with the interior actuating lever but also with an exterior actuating member, namely, the external handle for operating the door lock associated with that electrically-controlled operator.

In normal operation, the coupling lever is continuously in its ineffective position, i.e. the position in which operation of the interior actuating lever will not permit withdrawal of the keeper from its bolt-blocking position. In normal operation, moreover, all functions of the door lock are exclusively electrically controlled. To that extent the door lock, in spite of the presence of the interior actuating lever and an external handle, cannot be manually operated mechanically. Only in the case of an emergency, e.g. via a crash sensor, is the coupling lever brought into play, i.e. moved into its "effective" position by the electrically-controlled operator to enable mechanical (manual) emergency opening of the vehicle door.

This system has the drawback that damage to the single electrical operator of the vehicle door precludes operation either electrically or mechanically since the operator is no longer capable of performing either of its two functions. This is detrimental on safety grounds, especially in the case of an accident, and also is disadvantageous from a convenience or comfort point of view in case of failure for minor technological reasons.

OBJECTS OF THE INVENTION

It is therefore the principal object of the present invention to provide an improved central lock system for a motor vehicle whereby the aforementioned drawbacks are avoided.

Another object of this invention is to provide a central lock system which enables all functions to be electrically carried out but nevertheless does not prevent manual or mechanical operation when essential and thus is more reliable and safe than earlier systems.

It is still another object of the invention to provide an electrically-operated central lock control system which is particularly advantageous for door locks of a motor vehicle in which those locks are practically structurally identical.

SUMMARY OF THE INVENTION

These objects and others which will become apparent hereinafter are attained, in accordance with the present invention in a central lock system for an automotive vehicle having an electronic control device or central unit, connected to a multiplicity of electrically-operable motor vehicle door locks which advantageously are provided for each vehicle door, and electrical control lines connecting the central unit with the door locks.

Each of the door locks can have a rotary bolt which can engage a locking pin of a doorpost in a conventional manner for a vehicle door lock, thereby latching the door closed, and a keeper in the form of an angularly reciprocatable pawl which can engage the rotary bolt to hold the same in a locked position or to release the bolt so that it can rotate in an unlocked position.

The keeper pawl on the one hand can be shifted to its unlocking position by a first electrically-controllable operator and on the other hand by means of an interior actuating lever. The interior actuating lever, however, can be operatively connected with the pawl or keeper by means of a coupling lever shiftable between an effective position and an ineffective position. Displacement of the coupling lever between these two positions is effected, according to the invention, by a second electrically-operable actuator. In the effective position, the coupling lever acts mechanically upon the pawl.

According to the invention, the door locks for the various doors of a particular automotive vehicle are practically structurally identical and by control of the first electrically-operable actuator and the second electrically-operable actuator, according to the invention, each lock can be switched to the functions "operate", "locked and unlocked", "antitheft mode on and off" and "child-safe mode on and off."

With a locking system in accordance with the invention, all of the functions can be electrically controllable while, nevertheless, with the effective position of the coupling lever, a purely mechanical connection can be ensured between the interior actuating lever and the keeper pawl. The invention, therefore, provides two separate electrically-operable actuating elements which ensure that the central locking system can operate in a far more reliable manner than has hitherto been the case. Should, for example, the first electrically-operable actuator fail, the keeper pawl can nevertheless remain operable, for example, after the coupling lever has been shifted to its effective state by means of the second electrically-controllable actuator, via the internal actuating lever.

If, by contrast the second electrically-operable actuator should fail with the coupling lever in its ineffective state, the keeper pawl can be disengaged from the rotary bolt in normal operation by means of the first electrically-controllable actuator.

The probability of a simultaneous failure of two electrically-operable actuators is by at least one power less than the probability of failure of a single electrically-operable actuator. Generally by means of the coupling lever in combination with the second electrically-operable actuator, the lock can be secured in a simple and reliable way additionally for the antitheft and child-safety functions. When the coupling lever is in its ineffective position, both the antitheft mode and the child-safety mode are active. Conversely, with the coupling lever in its effective position, the antitheft and child-safety modes are disengaged or are inactive.

The antitheft function and the child-safety function refer to all of the locks or only those of the rear doors which then cannot be opened by actuation of the internal actuating lever. When these functions or means are inactive, the door locks can be opened from the interior selectively by means of the internal actuating lever or, with electrical unlocking, by means of the control unit.

As has been indicated previously, the door locks on all of the doors can be structurally identical which has been found to be especially cost-effective. The differentiation between the antitheft function and the child-safety function is found only in the control unit.

Reference to structural identity with respect to the constructions of the locks is intended to include mirror symmetrical configurations of the locks on the right and left sides of the vehicle.

In a preferred embodiment, the first electrically-operable actuator and/or the second electrically-operable actuator is an electric motor drive. The electric motor drive can have a speed-reducing transmission as may be desirable or required.

The "locking" and "unlocking" functions can be established by means of a bistable relay at each lock responsive to the central control and switchable between the "locking" and "unlocking" modes. In the "locking" mode of the bistable relay, the first electrically-operable actuator of a respective door lock is deenergized, i.e. cannot be supplied with electrical current by the control unit.

The bistable relay is a relay which each time it receives a current pulse can be switched from one stable state to another stable state. To that extent a bistable relay may be formed by a binary divider stage.

A bistable relay provides a simple electronic component for response at each door lock to the central locking functions commanded by the control unit.

It has been found to be advantageous to equip each door lock with a respective bistable relay. However, the function of the bistable relay can also be accomplished electronically in the control unit and/or in an electronic circuit integrated into the respective door lock. Such circuits can include signal processors or the like. When each door lock comprises a respective processor, the control system is particularly amenable to programming. Of course the system of the invention can operate with simple switches connected to the door locks to switch them from open to locked positions.

Specifically, a central locking system for an automotive vehicle can comprise:

- a respective electrically controllable door lock for each of a plurality of doors of the vehicle, each of the door locks including:
  - a respective rotary bolt on the door engageable with a respective pin,
  - a respective swingable keeper pivotable between a position in which the respective bolt is secured and a position in which the respective bolt is free to rotate,
  - a first electrically operable actuator operatively connected to the keeper for displacing same, and
  - an interior actuating lever operatively connectable to the keeper for displacing same,
  - a coupling lever selectively displaceable between an effective position connecting the interior actuating lever with the keeper and an ineffective position wherein displacement of the interior actuating lever cannot displace the keeper, and
  - a second electrically operable actuator operatively connected to the coupling lever for displacing the coupling lever between the effective and ineffective positions, the door locks for the plurality of doors all being practically structurally identical;

a central electrical control unit on the vehicle for controlling the locks; and at least one electrical control line connecting the central control unit to the locks for operating the first and the second electrically operable actuators of each lock from the central unit with the functions "operate," "lock and unlock," "antitheft mode on and off" and "child-safe mode on and off."

Advantageously, the keeper can be a pawl having a first release pin which is engageable by a spiral drive cam carried by a worm wheel meshing with a worm driven by an electric motor constituting the first electrically-operable actuator. The cam thus can displace the keeper out of engagement with the rotary bolt and change over the lock status from a locked state to a latched state.

The control of the first electrically-actuatable member or motor can be such that the motor is nonreversible, in which case the positions of the cam can be detected by an electrical positioning sensor which, after the cam has disengaged the pawl, is brought into a position determined by the position sensor in which the keeper pawl is permitted to again move in and engage the bolt. The "nonreversible" state of the system is intended to ensure that the drive cam will rotate only in one sense.

Alternatively, the first electrically-operable actuator can be reversible whereby the drive cam is rotated between mechanically-limited functional positions "actuated" and "nonactuated" back and forth. The first electrically-operable actuator can then be energized via the control unit for a time period t1 which is greater than the time period required for the back and forth operations, between "actuated" and "nonactuated" and referred to as the time period t2. "Reversing" is here used in the sense that the cam can be driven in both possible directions.

According to another feature of the invention, the keeper pawl has a second release pin which can engage a release lever having an abutment surface, which in turn cooperates with an abutment pin on the coupling lever. The abutment pin, in turn, by engagement with the release lever, shifts the latter between functional positions "antitheft protection on" and "antitheft protection off" or "child-safety mode on" and "child-safety mode off." The pin disengages from the abutment to establish the "antitheft security on" and the "child-safety mode on" states preventing operation of the mechanism by the interior lever. In the last-mentioned functional states, the operation of the interior lever is effected with lost motion or free travel.

The coupling lever, moreover, can comprise a first coupling member or lever part which is pivotally connected to a second coupling lever part which carries the coupling lever pin bearing upon the release lever. The first coupling part has a gear segment which meshes with a gear of the second electrically-operable actuator.

By means of the second electrically-operable actuator, the first coupling part can be swung and as a result, the second coupling part can be swung back and forth.

The central locking unit can also have various constructions. It is especially advantageous to provide the electrical control line with a serial bus, preferably as a serial single-conductor bus. In that case each of the vehicle door locks can have a control and driver circuit for supplying the first and second electrically-operable actuators. The control and driver circuits can include demultiplexers for receiving the control signals from the bus and feeding the first and second actuators respectively. The control signals are serially transmitted digital signals.

Especially when the bus is a serial single-conductor bus, it is only necessary to provide a current supply connection for each of the electrically-controllable components. The counterpole can be a chassis which can form a common ground for the signal line as well.

In particular, each of the control and driver circuits can include a processor in which a lock identity code word is stored in a respective memory and the control unit can include a central processor with a memory or storage for a control device identity code word. The identity code words that are stored in memory can be interrogated upon signal processing and compared with those of the central unit with any noncorrespondence between at least the interrogated lock identity code word and the control device identity code word triggering the antitheft or child-protection modes into the "on" state and/or, deactivating the control unit to render the lock system inoperative in the antitheft or child-safe mode. The usual identity code words can include a so-called family name of the particular central lock system.

In that case, if a door lock is replaced and/or the control unit is replaced in an attempt to restore the system to operation after a theft of the automotive vehicle, the unfamiliar unit will be recognized as such by the failure of the comparison of the stored identity codes and the central locking system will remain inactive with the locks fully secured. Thus not only does the present invention provide security against theft but, should a theft occur, it makes more difficult the resale of the stolen vehicle and its convenient use following the theft.

Deactivation in the case of a failure to identify a component with the same family identity means that the identity code word in memory will be extinguished so that the elements of the central locking system will remain unusable until an authorized dealer or service station can reprogram the processors using, for example, a diagnostic unit which can be coupled to the central processor.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
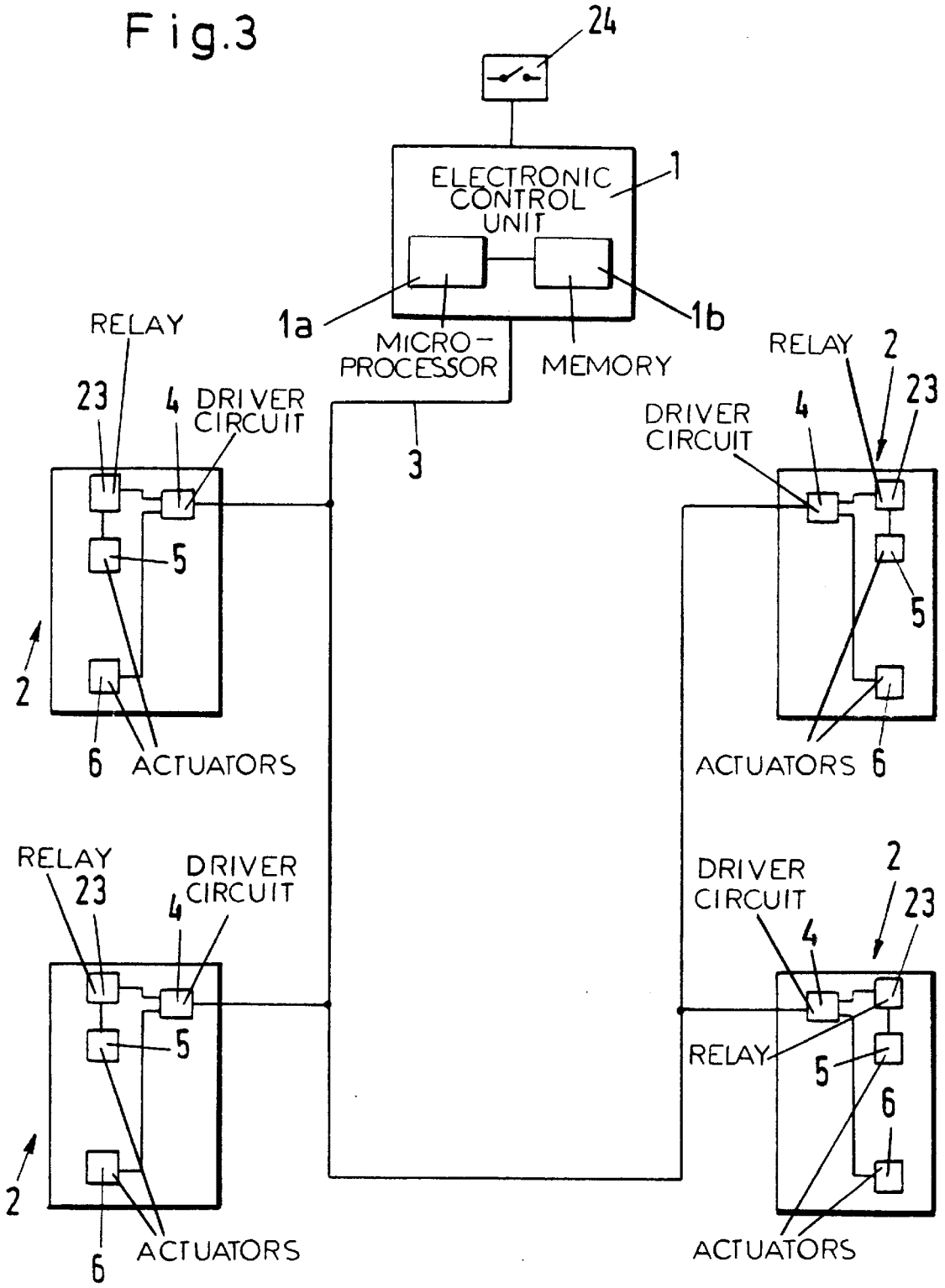
FIG. 3 is a block diagram of the central locking system.

Turning to FIG. 3 it can be seen that basically the central lock system of the invention comprises an electronic control unit 1 which can include a microprocessor 1*a* and a memory 1*b* can be connected to a plurality of electrically-controllable door locks 2 by an electrical control line 3, here shown as a serial single-conductor bus. The return is through the common chassis ground.

In the embodiment illustrated, there are four door locks 2 for a four-door vehicle.

Each of the locks 2 has a respective control and driver circuit 4 including a microprocessor which is, in turn, connected to the first and second actuators of the lock represented at 5 and 6 respectively. The first actuator may be connected to the driver circuit 4 through a bistable relay 23 which will be described in greater detail hereinafter.

According to the invention, the circuits 4 can include or can be programmed to be demultiplexers for receiving the serial control signals transmitted over the bus 3 and for converting them to control signals for the first actuator 5 and the second actuator 6. Correspondingly, the control unit 1 can have its microprocessor la programmed to constitute a multiplexer or can include a separate multiplexer.

While the system as thus far described uses unidirectional information or control signal flow, a bidirectional signal transmission is also possible. For example, the processors of the circuits 4 can dialogue with the central unit 1 and can transmit signals indicating the state of the respective lock to the central unit.

Each of the processors of the control and driver circuits 4 can be provided with a lock identity code word storage or memory. Correspondingly, the control unit 1 has a memory for storage 1*b* connected to its central processor 1*a* and serving as a control system identity code word storage. Each of the identity code word memories or stores has a respective identity code word stored therein and can output this code word upon interrogation so that the code words can be compared with one another. Upon a failure of agreement between interrogated identity code words, the door locks 2 are automatically brought into the "antitheft securing mode on" and "child-safety mode on" positions and deactivated. Alternatively or simultaneously, the control unit 1 can be deactivated.

Figure 1:
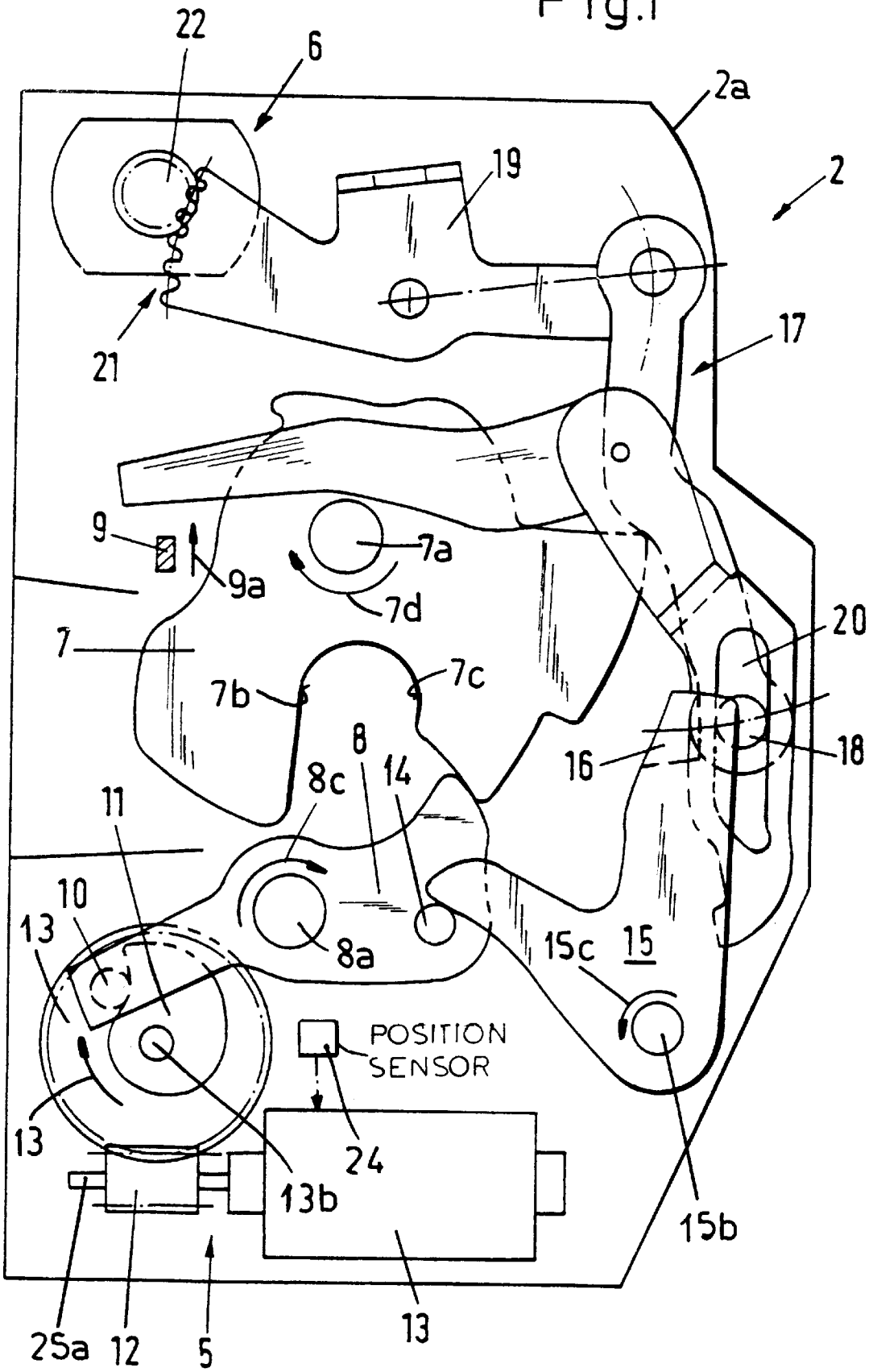
FIG. 1 is a diagram of a vehicle door lock for use in a central lock system in accordance with the invention and illustrated with the parts thereof in the antitheft mode "off" or child-safety mode "off"
Figure 2:
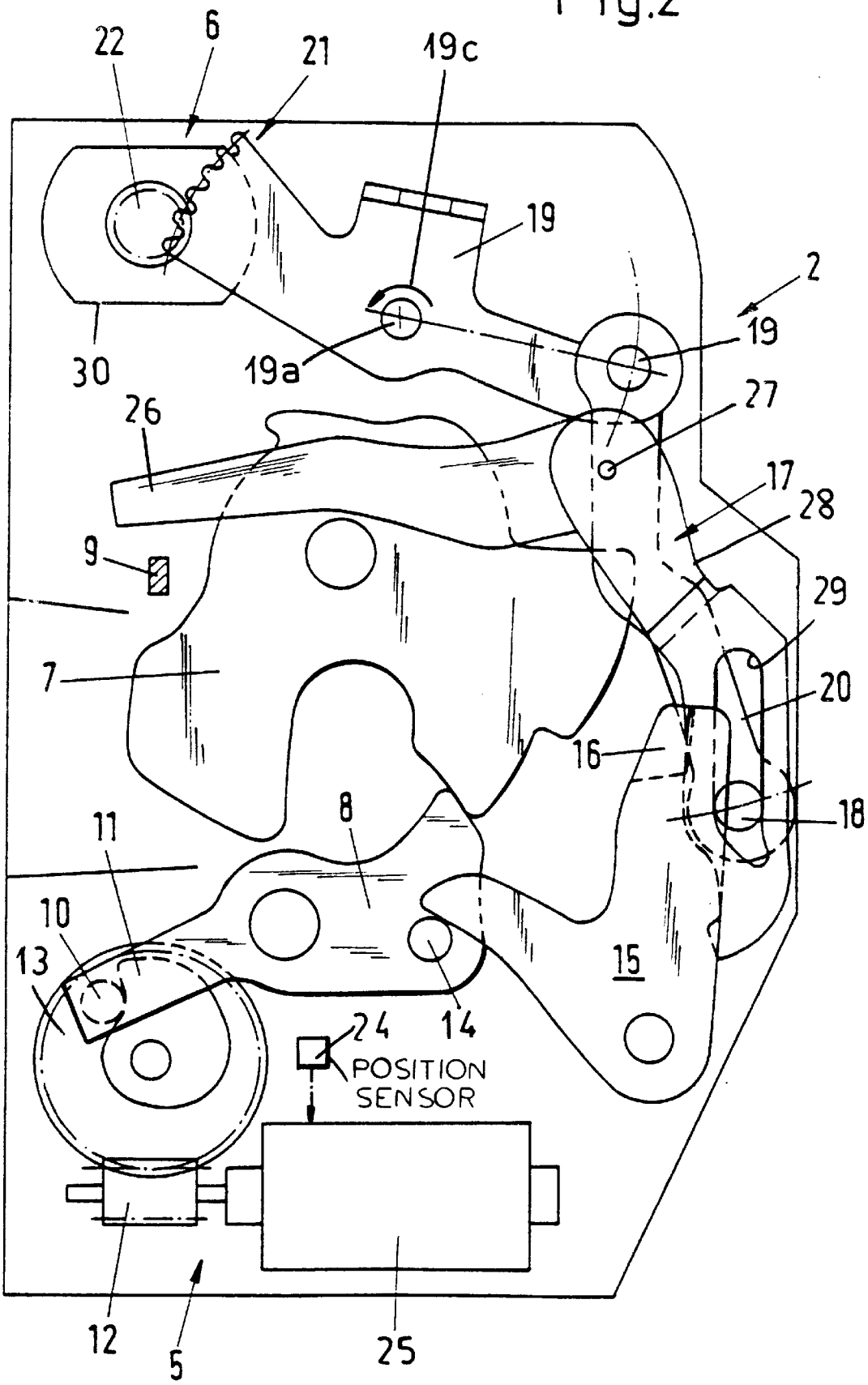
FIG. 2 is a view similar to FIG. 1 in the state corresponding to antitheft mode "on" or child-safety mode "on"

From FIGS. 1 and 2 it can be seen that each of the door locks 2, all of which are structurally identical and thus can have the configuration shown in FIGS. 1 and 2 or a mirror image configuration, can comprise in a lock housing 2*a* into which the microprocessor or driver circuit 4 can be integrated, a rotary bolt 7 rotatable about a pin 7*a* and having a notch 7*b* which is designed to receive a pin on the doorpost of the vehicle door (not shown) with which the rotary bolt cooperates in the locking action. That pin, when engaged in the notch of the bolt 7 in the position shown in FIGS. 1 and 2 fixes the door to the chassis of the vehicle so that the door is held closed.

Cooperating with the rotary bolt 7 is a keeper 8 in the form of a pawl which, in turn, can swing about the pivot pin 8*a* and has a surface 8*b* which engages against a surface 7*c* forming a flank of the notch 7*b* to hold the bolt 7 in the position shown in FIGS. 1 and 2 when the keeper 8 is in its counterclockwise position. When the keeper 8 is swung in the clockwise sense as represented by the arrow the surface 8*a* can clear the surface 7*c* and the rotary bolt 7 is free to rotate in the clockwise sense represented by the arrow 7*d* to release the doorpost pin and allow the door to open.

The keeper pawl 8 is actuatable on the one hand by means of a first electrically-operable actuator generally shown at 5 and, on the other hand, by means of an interior actuating lever 9 which has only been partly represented and can be movable vertically in the direction represented by the arrow 9*a* to swing the pawl 8 in the clockwise sense represented by the arrow 8*a* as will be described in greater detail below.

More particularly, the keeper pawl 8 has at one end, a release pin 10 in the path of a spiral cam 11 which is fixed to a worm wheel 13 meshing with a worm 12 on a shaft 25*a* of an electric motor 25 of the actuator 5, the worm 12 and the worm wheel 13 forming a step-down transmission. The position sensor 24 may respond to the position of the cam and can control the motor 25 to stop the latter when the motor 25 is not reversibly driven. It will be apparent, therefore, that when the worm wheel 13 is driven in the clockwise sense represented by the arrow 13*a* about the axis 13*b* of this worm wheel, the spiral cam 11 will displace the keeper pawl 8 in the clockwise sense and disengage it from the rotary bolt 7. The motor 25 can alternatively be driven for fixed periods of time reversibly.

The position sensor 24 is designed, when the motor 25 is driven unidirectionally and not reversibly, to halt the cam 11 in a position in which the keeper pawl 8 can reengage in the notch 7*b* to lock the bolt 7. The actuation of the keeper pawl 8 thus involves a complete revolution of the cam 11.

When, however, the motor 25 is reversibly driven, the cam 11 is shiftable between two functionally distinct positions "actuated" and "nonactuated" whereby the motor 25 is energized for a time period t1 which is greater than the time period t2 requires for the back and forth movement of the cam between the two functional positions.

As is also apparent from FIGS. 1 and 2, the keeper pawl 8 has a second release pin 14 which can be engaged by a finger 15*a* of a release lever 15 pivotal about a pin 15*b* and having an abutment surface 16 in the path of a coupling pin 18.

As a comparison of FIGS. 1 and 2 will show, a coupling lever 17 can be shiftable between "effective" and "ineffective" positions.

The release lever 15 is displaceable between the functional positions "antitheft off" and "antitheft on", depending upon the position of the pin 18. The pin 18 can displace the lever 15 into the "antitheft off" or "child-safety off" position in the effective position of the lever 17 by an operation of the interior lever 9 which swings a lever 26 in the clockwise sense about its pin 27. The lever 26 has a member 28 formed with a slot 29 in which the pin 18 is guided and thus can bring the pin against the abutment 16 only in the effective position of lever 17.

The pin 18 and the lever 17 are in their effective position as shown in FIG. 1 and in the ineffective position as shown in FIG. 2, where the pin 18 is located below the abutment 16 and thus clears it in the event of a lifting of lever 19 and a clockwise swing of the lever system 26, 28, 29.

In the embodiment of FIG. 2, therefore, the antitheft protection and child-safety protection is "on".

From FIGS. 1 and 2 it is also apparent that the coupling lever 17 has a first coupling lever part 19 in the form of a lever pivotal about a pin 19a and having a gear segment 21 formed on one end thereof, the segment meshing with a pinion 22 of a step-down transmission connected to an electric motor 30 of the second electrically-operable actuator 6. The lever portion 19 is connected via an articulation 19b with the second lever portion 20 of lever 17. It is this second lever portion 20 which carries the coupling pin 18 previously described.

When the lever member 19 is swung in the counterclockwise sense as represented by the arrow 19*c* about its pivot 19*a* via the electric motor 30, the pin 18 is raised so that the lever 28 can urge it against the abutment 16 to swing the release lever 15 in the counterclockwise sense represented by the arrow 15*c* upon lifting of the lever 9 to thereby press the pin 14 downwardly and swing the keeper pawl 8 in the clockwise sense.

From FIG. 3 it will also be apparent that the "locking" and "unlocking" functions are established for the respective locks by the energization from the central unit 1 of respective bistable relays 23 which can be built into the locks and have electrical functional states of "locked" and "unlocked" as their two stable states. In the "locked" state of each relay, the respective first electrically-operable actuator 5 is not energizable with electric power from the control device. The locks cannot be opened by the cams 11.

The two electrical actuators of each lock thus ensure that the locks will be electrically actuatable to establish the "operated" "locked" "unlocked", "antitheft mode on and off" and "child-safety mode on and off." What has not been shown in detail is that the central control unit 1 can be operated by switches as represented at 24 within the vehicle as well as by a remote control utilizing infrared or high frequency radio wave transmission from a remote control unit although these possibilities are fully within the invention.

We claim:

1. A central locking system for an automotive vehicle comprising:

a respective electrically controllable door lock for each of a plurality of doors of said vehicle, each of said door locks including:

a respective rotary bolt on the door engageable with a respective pin, a respective swingable keeper pivotable between a position in which the respective bolt is secured and a position in which the respective bolt is free to rotate, a first electrically operable actuator operatively connected to said keeper for displacing same, and an interior actuating lever operatively connectable to said keeper for displacing same, a coupling lever selectively displaceable between an effective position connecting said interior actuating lever with said keeper and an ineffective position wherein displacement of said interior actuating lever cannot displace said keeper, and a second electrically operable actuator operatively connected to said coupling lever for displacing said coupling lever between said effective and ineffective positions, said door locks for said plurality of doors all being practically structurally identical;

a central electrical control unit on the vehicle for controlling said locks; and at least one electrical control line connecting said central control unit to said locks for operating the first and the second electrically operable actuators of each lock from said central unit with the functions "operate," "lock and unlock," "antitheft mode on and off" and "child-safe mode on and off", each of said locks being provided with a bistable relay controlled by said central unit and electrically settable to "unlocking" and "locking" modes, each relay disconnecting current flow to said first electrically operable actuator of the respective lock in said "locking" mode.

2. The central locking system defined in claim 1 wherein at least one of said electrically operable actuators of each lock is an electric motor drive.

3. The central locking system defined in claim 1 wherein said keeper is a pawl having a pivot and a release pin displaceable to swing said pawl, said first electrically operable actuator including an electric motor, a worm drive driven by said motor and a worm wheel meshing with said worm, and a spiral cam on said worm wheel engageable with said release pin.

4. The central locking system defined in claim 3 wherein said motor is nonreversibly driven, said cam being monitored by a position sensor to be held in a position, after said cam has disengaged said pawl from said rotary bolt, to permit said cam to permit said pawl to reengage said bolt and lock the bolt against rotation.

5. The central locking system defined in claim 3 wherein said motor is reversible and said cam is displaceable back and forth between "actuated" and "nonactuated" functional positions, said motor being energizable by said control unit for a time period t1 which is greater than a time period t2 sufficient for the back and forth displacement of the cam between the "actuated" and "nonactuated" functional positions.

6. The central locking system defined in claim 1 wherein said electrical control line is a serial bus and each of said door locks further comprises a respective control and driver circuit for controlling the respective first and second electrically operable actuators, each of said circuits forming a respective demultiplexer for receiving and processing serial control signals transmitted from the control unit over said bus to the respective actuators of said door locks.

7. The central locking system defined in claim 1 wherein each of said door locks has a control and driver circuit for controlling the respective first electrically-operable actuator and second electrically-operable actuator, each of said circuits including a processor with a lock-identifier code word memory, said control unit including a central processor with a control word memory for being verifiable in a comparison check for setting the antitheft mode and child safety mode on and off deactivating same and for deactivating said control unit.

8. A central locking system for an automotive vehicle comprising:

a respective electrically controllable door lock for each of a plurality of doors of said vehicle, each of said door locks including:

a respective rotary bolt on the door engageable with a respective pin, a respective swingable keeper pivotable between a position in which the respective bolt is secured and a position in which the respective bolt is free to rotate, a first electrically operable actuator operatively connected to said keeper for displacing same, and an interior actuating lever operatively connectable to said keeper for displacing same, a coupling lever selectively displaceable between an effective position connecting said interior actuating lever with said keeper and an ineffective position wherein displacement of said interior actuating lever cannot displace said keeper, and a second electrically operable actuator operatively connected to said coupling lever for displacing said coupling lever between said effective and ineffective positions, said door locks for said plurality of doors all being practically structurally identical;

a central electrical control unit on the vehicle for controlling said locks; and at least one electrical control line connecting said central control unit to said locks for operating the first and the second electrically operable actuators of each lock from said central unit with the functions "operate," "lock and unlock," "antitheft mode on and off" and "child-safe mode on and off," said keeper is a pawl having a pivot and a release pin displaceable to swing said pawl said first electrically operable actuator including an electric motor, a worm drive driven by said motor and a worm wheel meshing with said worm, and a spiral cam on said worm wheel engageable with said release pin, said pawl having a second release pin on an opposite side of said pivot from the first mentioned release pin, each of said locks further comprising a release lever engageable with said second pin and having an abutment surface, the respective coupling lever having an operating pin displaceable against said abutment surface in "antitheft mode off" and "child-safety mode off" positions and being out of engagement with said abutment surface in "antitheft mode on" and "child-safety mode on" positions as selected by operation of said interior actuating lever, said coupling lever having a first lever portion articulated to a second lever portion, said second lever portion carrying said operating pin, said first lever portion having a gear segment meshing with a pinion of said second electrically operable actuator.

* * * * *